US008307721B2

(12) United States Patent
Motadel

(10) Patent No.: US 8,307,721 B2
(45) Date of Patent: Nov. 13, 2012

(54) FLEXIBLE PIPETTE TIPS

(75) Inventor: Arta Motadel, San Diego, CA (US)

(73) Assignee: Biotix, Inc., San Diego, CA (US)

( * ) Notice: Subject to any disclaimer, the term of this patent is extended or adjusted under 35 U.S.C. 154(b) by 220 days.

(21) Appl. No.: 12/685,590

(22) Filed: Jan. 11, 2010

(65) Prior Publication Data

US 2010/0218622 A1 Sep. 2, 2010

Related U.S. Application Data

(60) Provisional application No. 61/144,031, filed on Jan. 12, 2009.

(51) Int. Cl.
*B01L 3/02* (2006.01)

(52) U.S. Cl. ..... 73/864.01; 422/525

(58) Field of Classification Search ..... 422/524–526
See application file for complete search history.

(56) References Cited

U.S. PATENT DOCUMENTS

| | | | | |
|---|---|---|---|---|
| D255,601 | S | 6/1980 | De Vaughn | |
| D256,052 | S | 7/1980 | De Vaughn | |
| 4,707,337 | A | 11/1987 | Jeffs et al. | |
| 4,763,695 | A * | 8/1988 | Dooley | 138/109 |
| D300,561 | S | 4/1989 | Asa et al. | |
| 5,032,343 | A | 7/1991 | Jeffs et al. | |
| 5,156,811 | A | 10/1992 | White | |
| 5,232,669 | A * | 8/1993 | Pardinas | 422/526 |
| 5,660,797 | A * | 8/1997 | Jarvimaki | 422/525 |
| D384,418 | S | 9/1997 | Torti et al. | |
| D439,986 | S | 4/2001 | Petrek | |
| D461,904 | S | 8/2002 | Petrek | |
| D465,844 | S | 11/2002 | Anderson et al. | |
| 6,596,240 | B2 | 7/2003 | Taggart et al. | |
| D487,593 | S | 3/2004 | Sarna | |
| 7,335,337 | B1 | 2/2008 | Smith | |
| 2005/0255005 | A1 | 11/2005 | Motadel | |
| 2007/0017870 | A1 | 1/2007 | Belov | |
| 2007/0231215 | A1 | 10/2007 | Mototsu et al. | |
| 2010/0196210 | A1 * | 8/2010 | Jungheim et al. | 422/100 |
| 2010/0218622 | A1 | 9/2010 | Motatel | |

FOREIGN PATENT DOCUMENTS

| | | | |
|---|---|---|---|
| JP | 08-266913 | | 10/1996 |
| RU | 2 144 158 | * | 1/2000 |
| WO | WO 2010/081107 | | 7/2010 |

OTHER PUBLICATIONS

International Search Report and Written Opinion mailed on: Aug. 25, 2010 in International Application No. PCT/US2010/020666 filed on Jan. 11, 2010 and published as: WO 10/081107 on: Jul. 15, 2010.
International Preliminary Report on Patentability mailed on: Jul. 21, 2011 in International Application No. PCT/US2010/020666 filed on Jan. 11, 2010 and published as: WO 10/081107 on: Jul. 15, 2010.
Office Action mailed on: Jun. 21, 2011 in U.S. Appl. No. 29/354,398, filed on Jan. 22, 2010.
Office Action mailed on: Jan. 31, 2011 in U.S. Appl. No. 29/354,398, filed on Jan. 22, 2010.
Office Action mailed on: Jan. 12, 2011 in U.S. Appl. No. 29/354,398, filed on Jan. 22, 2010.
Sorenson low binding aerosol barrier tips, MicroReach Guard, capacity 10ul. Catalog No. Z719390, Sigma-Aldrich Co. 2010 Catalog, Printed from the internet on Sep. 9, 2010.

* cited by examiner

*Primary Examiner* — Robert R Raevis
(74) *Attorney, Agent, or Firm* — Grant Anderson LLP

(57) ABSTRACT

Described herein are pipette tips that include rigid axial projections circumferentially disposed around the exterior surface of a relatively more compliant annular member. The rigid, axial projections may enable improved, and often optimal, sealing engagement with a dispensing device by (i) allowing deformation of the annular member between the projections, and (ii) restraining overall deformation of the annular member. Pipette tip embodiments described herein readily form a desired seal with a dispensing device, and permit ejection after use without modification to the dispensing device.

13 Claims, 1 Drawing Sheet

FLEXIBLE PIPETTE TIPS

RELATED PATENT APPLICATION

This patent application claims the benefit of U.S. Provisional Patent Application No. 61/144,031 filed on Jan. 12, 2009, entitled FLEXIBLE PIPETTE TIPS, naming Arta Motadel as an inventor. The entire content of the foregoing provisional patent application hereby is incorporated by reference, including all text, tables and drawings.

FIELD

The technology relates in part to pipette tips, and methods for manufacturing and using the same.

BACKGROUND

Pipette tips are ubiquitous tools of many research laboratories and of facilities in which small volumes of liquid are handled. Liquid dispensers sometimes are manually operated by a user and sometimes are automated. Liquid dispensing devices often are operated in conjunction with pipette tips, where the dispensing devices apply negative or positive pressure in the pipette tip interior and liquid enters or exits, respectively, the pipette tip. Pipette tips used with dispensing devices often are composed of a single, rigid material.

SUMMARY

Pipette tips composed of a single, rigid material sometimes fail to form adequate seals with the portion of a liquid dispensing device that engages the pipette tip (e.g., a nozzle of a robotic high-throughput dispensing device). Pipette tips having a compliant material in combination with a rigid material can deform too much in some designs, or can deform too little in other designs, and not provide a proper seal with a dispensing device. Inadequate seals formed with pipette tips often give rise to errors when liquids are handled.

Pipette tips described herein can readily form a working seal with dispensing devices. This advantage is in part due to the restrained flexibility of dispenser engagement portions of the tips. Pipette tips described herein include rigid axial projections that are circumferentially disposed around the exterior surface of a more compliant annular member. Without being limited by theory, the rigid, axial projections may enable improved, or optimal, sealing engagement with a dispensing device by (i) allowing deformation of the annular member between the projections, and (ii) restraining overall deformation of the annular member. Pipette tips described herein readily form a desired seal with a dispensing device, and permit ejection after use without modification to the dispensing device. Pipette tips described herein also provide an advantage that one pipette tip can form a seal with a range of different dispensing devices that may have different pipette tip engagement member sizes and geometries.

Thus, provided herein is a disposable pipette tip, which comprises (i) a distal section, and (ii) a proximal section comprising a plurality of axial projections that extend from the distal section and are circumferentially disposed around the exterior surface of an annular member, where: (a) the annular member is disposed coaxially with respect to the distal section, (b) the projections and the distal section consist essentially of a first material and the annular member consists essentially of a second material relatively more compliant than the first material, (c) the projections cover a portion of the surface area of the annular member, whereby portions of the annular member between the projections are exposed, and (d) the portions of the annular member between the projections deform when a pipette device is inserted into the proximal portion of the pipette tip. The projections are coaxially disposed relative to the longitudinal axis of the distal section, in certain embodiments. The proximal section can comprise a ring in connection with the ends of the projections, in some embodiments, and sometimes the ring consists essentially of the first material. In certain embodiments, the second material is a moldable thermoplastic elastomer, and in some embodiments, the first material is polyethylene. A portion of the annular member is in effective contact with the distal section in certain embodiments.

Also provided is a method for manufacturing a disposable pipette tip described herein, which comprises: providing a cast; introducing the first material to the cast; and introducing the second material to the cast. In some embodiments, the first material is introduced to the cast and then the second material is introduced to the cast after the first material has cured. In other embodiments, the second material is introduced to the cast and then the first material is introduced to the cast after the second material has cured. The method of manufacture can comprise removing the disposable pipette tip from the cast in some embodiments.

Provided also is a method for using the disposable pipette tip described herein, which comprises: (a) inserting a dispensing device into the proximal section of the disposable pipette tip, where the portions of the annular member between the projections deform; and (b) applying negative pressure to the disposable pipette tip via the dispensing device and introducing a liquid into the distal portion of the disposable pipette tip. The method, in some embodiments, comprises ejecting the liquid from the distal portion of the disposable pipette tip. The method also may comprise ejecting the disposable pipette tip from the dispensing device.

A material used to manufacture the distal section and/or the proximal section may contain one or more components. In some embodiments, the first material may share no common component with the second material. The first material, in certain embodiments, shares one or more common components with the second material.

Certain embodiments are described further in the following description, claims and drawings.

BRIEF DESCRIPTION OF THE DRAWINGS

The drawings illustrate certain non-limiting embodiments of the technology.

DETAILED DESCRIPTION

Figure 1:
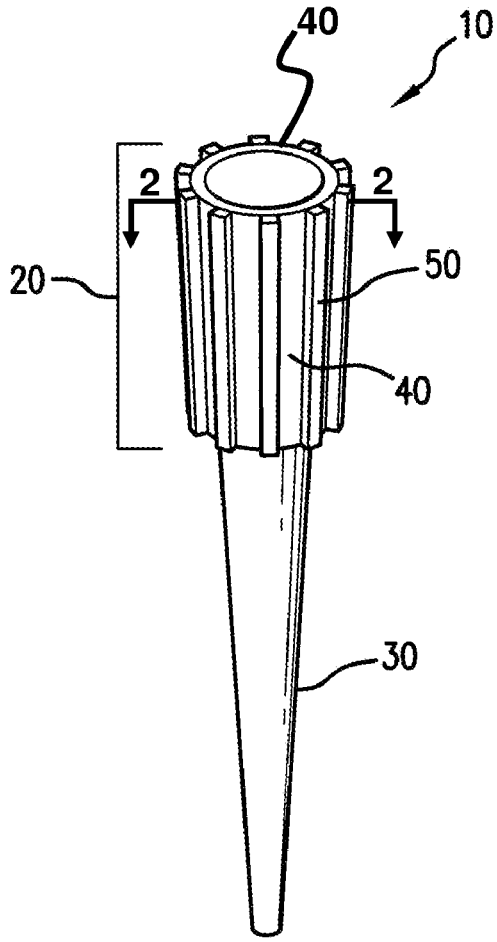
FIG. 1 shows a top isometric view of a pipette tip 10.

Pipette tips described herein can be utilized in conjunction with a variety of dispensing devices, including, without limitation, manual pipettors and automatic or robotic pipettors. Pipette tip embodiments as described herein facilitate use (e.g., automatic use) by sealingly engaging multiple types of liquid dispensers without requiring that the dispensers are modified to permit such seals or ejection of the tips. The described tips can be superior to certain tips presently in use because they are less likely to form incomplete seals with dispensing devices and therefore less likely to cause liquid handling errors. Pipette tips described herein can be used in a variety of applications, including, without limitation, manual liquid manipulation, automated liquid manipulation, robotic liquid manipulation, liquid manipulation in forensic applications, liquid manipulation in medical, diagnostic, drug discovery, research and other applications.

Pipette Tips

A disposable pipette tip described herein can be of any geometry suitable for dispensing fluids in combination with a dispensing device. Pipette tips sometimes are available in sizes that hold from 0 to 10 microliters, 0 to 20 microliters, 1 to 100 microliters, 1 to 200 microliters and from 1 to 1000 microliters, for example. The external appearance of pipette tips may differ, and certain pipette tips can have a continuous tapered wall forming a central channel or tube that is roughly circular in horizontal cross section, in some embodiments. A pipette tip can have any cross-sectional geometry that results in a tip that (i) provides suitable flow characteristics, and (ii) can be fitted to a pipette, for example. Pipette tips sometimes taper from the widest point at the top-most portion of the pipette tip (pipette proximal end or end that fits onto pipette), to a narrow opening at the bottom most portion of the pipette tip (pipette distal end or end used to acquire or dispense samples). In certain embodiments, a pipette tip wall includes two or more taper angles. The inner surface of the pipette tip sometimes forms a tapered continuous wall, in some embodiments, and in certain embodiments, the external wall may assume an appearance ranging from a continuous taper to a stepped taper or a combination of smooth taper with external protrusions. An advantage of an externally stepped taper is compatibility with pipette tip racks from different manufacturers. The bore of the top-most portion of the central channel or tube generally is wide enough to accept a particular pipette apparatus (e.g., nozzle, barrel).

In some embodiments, a pipette tip has (i) an overall length of about 1.10 inches to about 3.50 inches (e.g., about 1.25, 1.50, 1.75, 2.00, 2.25, 2.50, 2.75, 3.00, 3.25 inches); (ii) a fluid-emitting distal section terminus having an inner diameter of about 0.01 inches to about 0.03 inches (e.g., about 0.015, 0.020, 0.025 inches) and an outer diameter of about 0.02 to about 0.7 inches (e.g., about 0.025, 0.03, 0.04, 0.05, 0.06 inches); and (iii) a dispenser-engaging proximal section terminus having an inner diameter of about 0.10 inches to about 0.40 inches (e.g., about 0.15, 0.20, 0.25, 0.30, 0.35 inches) and an outer diameter of about 0.15 to about 0.45 inches (e.g., about 0.20, 0.25, 0.30, 0.35, 0.45 inches). In the latter embodiments, the inner diameter is less than the outer diameter.

The wall of the distal section of a pipette tip sometimes is continuously tapered from the wider portion, which is in effective connection with the proximal section, to a narrower terminus. The wall of the distal section, in some embodiments, forms a stepped tapered surface. The angle of each taper in a distal section is between about zero degrees to about thirty degrees from the central longitudinal vertical axis of the pipette tip (e.g., about 0, 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 degrees), in certain embodiments. In some embodiments, the wall of the distal section forms stepped vertical sections. The wall thickness of a distal section may be constant along the length of the section, or may vary with the length of the section (e.g., the wall of the distal section closer to the proximal section of the pipette tip may be thicker or thinner than the wall closer to the distal section terminus; the thickness may continuously thicken or thin over the length of the wall). The distal section of a pipette tip generally terminates in an aperture through which fluid passes into or out of the distal portion. A distal section of a pipette tip may contain a filter, insert or other material, as addressed herein.

The wall of the proximal section of a pipette tip sometimes is continuously tapered from the top portion, to a narrower terminus. The top portion generally is open and often is shaped to receive a pipette tip engagement portion of a dispensing device. The wall of a proximal section, in some embodiments, forms a stepped tapered surface. The angle of each taper in the proximal section is between about zero degrees to about thirty degrees from the central longitudinal vertical axis of the pipette tip (e.g., about 0, 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 degrees), in certain embodiments. The wall thickness of a proximal section may be constant over the length of the section, or may vary with the length of the proximal section (e.g., the wall of the proximal section closer to the distal section of the pipette tip may be thicker or thinner than the wall closer to the top of the proximal section; the thickness may continuously thicken or thin over the length of the wall). A proximal section of a pipette tip may contain a filter, insert or other material, as addressed herein.

An axial projection generally has a longitudinal length greater than cross section lengths, and in some embodiments, the longitudinal length is significantly and substantially greater than a cross section length. An axial projection can have any convenient cross section geometry, including, without limitation, circular, oval, square, rectangular, rhomboid, parallelogram and the like. A distal section of a pipette tip is constructed from the same material as the axial projections, in certain embodiments, and axial projections often are in effective connection with the distal section in a pipette tip. In certain embodiments, a terminal portion of an axial projection is in connection with a terminal portion of the distal section of a pipette tip, and the thickness of the axial projection may be greater than, equal to, or less than the thickness of the distal section to which it is in connection. In some embodiments, a portion of an axial projection overlaps with a portion of the distal section of a pipette tip, and the thickness of the axial projection may be greater than, equal to, or less than the thickness of the distal section to which it is in connection. In some embodiments, the axial projections traverse the thickness of the annular member. In the latter embodiments, axial projections may partially traverse the annular member thickness, or fully traverse the annular member thickness and present a surface in the pipette tip proximal section interior (e.g., yielding sectioned annular member), in some embodiments. In certain embodiments, axial projection surfaces are set off from the annular member surface (e.g., 0.001 millimeters to about 0.5 millimeter set off distance between surfaces), and sometimes axial member surfaces are in contact with annular member surfaces (e.g., surfaces are not set off), in which embodiments axial projections do not traverse the thickness of the annular member and do not present a surface in the pipette tip proximal section interior.

Each axial projection of a pipette tip may have the same geometry in certain embodiments (e.g., same cross section shape and area, same length, same thickness, same circumferential distance between projections). In some embodiments, one or more axial projections of a pipette tip may have one or more different geometric features as compared to other axial projections of the pipette tip (e.g., different cross section shape, different cross section area, different length, different thickness, different circumferential distance or spacing between projections).

The overall shape of the annular member matches the shape of the proximal section in certain embodiments. The axial length of an annular member sometimes is greater than or equal to its width (e.g., external diameter), and in some embodiments, the axial length of an annular member is less than its width. The annular member sometimes is directly connected to the distal section of a pipette tip (e.g., at terminal edges of the annular member and distal section, or walls of the annular member and distal section), and in some embodiments, the annular member is in effective connection or fluid connection with the distal section of a pipette tip (e.g., the annular member may be connected to the distal section via a filter).

Axial projections can provide vertical stability to the flexed annular member (e.g., limit expansion of the annual member when a dispensing device is inserted into a disposable pipette tip) and can limit the degree to which the annular member deforms. In certain embodiments, as measured in the topmost cross section of the proximal section shown in FIG. 1, one point located on the top edge of the annular member deflects a maximum distance of about 0.001 millimeters to about 5 millimeters from the center point of the cross section. The maximum distance of deflection is about 0.000001, 0.000005, 0.00001, 0.00005, 0.0001, 0.0005, 0.001, 0.005, 0.01, 0.05, 0.1, 0.5, 1, 2, 3 or 4 millimeters in some embodiments.

Any suitable material can be used for the distal section and/or axial projections, and the material(s) used to manufacture such sections often are relatively more rigid than the material(s) used to manufacture the annular member. Any suitable rigid material can be utilized, including, without limitation, materials having one or more of the following properties, in certain embodiments: a melt flow rate (230 degrees Celcius at 2.16 kg) of about 30 to about 75 grams per 10 minutes using an ASTM D 1238 test method; a tensile strength at yield of about 3900 to about 5000 pounds per square inch using an ASTM D 638 test method; a tensile elongation at yield of about 7 to about 14% using an ASTM D 638 test method; a flexural modulus at 1% sectant of about 110,000 to about 240,000 pounds per square inch using an ASTM D 790 test method; a notched Izod impact strength (23 degrees Celcius) of about 0.4 to about 4.0 foot pounds per inch using an ASTM D 256 test method; and/or a heat deflection temperature (at 0.455 MPa) of about 160 degrees to about 250 degrees Fahrenheit using an ASTM D 648 test method. A material used to construct the distal section and/or axial projections include moldable materials in some embodiments. Non-limiting examples of materials that can be used to manufacture the distal section and/or axial projections include polypropylene, polystyrene, polyethylene, polycarbonate, and the like, and mixtures thereof. For example, PROFAX PD702, PROFAX PF531, PURELL X50109 or CYRELL EM1791 may be utilized in certain embodiments. Material(s) used to manufacture the distal section and/or axial section sometimes is conductive, and in some embodiments comprises a metal (e.g., metal alloy, steel (e.g., stainless steel), aluminum). In certain embodiments, glass can be used for the manufacture the distal section and/or axial section, and in some embodiments, a ceramic material can be used for the manufacture the distal section and/or axial section of pipette tips described herein.

Material(s) used to form the annular member often is/are measurably more flexible and resilient than the material(s) used to manufacture the axial projections. Material used to form the axial projections sometimes is moldable and often is different than the material used to form the annular member. In certain embodiments, the axial projections and annular member are formed from the same material, where one of the regions is formed using a different curing process, and/or is formed using a curing agent not used for the other that imparts a different resilience and hardness in the cured element.

The annular member sometimes is constructed from a polymeric material that allows the proximal section of the tip to expand and accept a nozzle when the tip is being deployed for use. The relatively more flexible material provides a large sealing area, larger than the sealing area in conventional single-shot pipette tips, and reduces the amount of force required to attach and eject the tip. Any suitable material can be used to construct the annular member, including, without limitation, materials having a hardness grade from 35 Shore A to 50 Shore D. In certain embodiments, the annular member is constructed using a thermoplastic elastomer (TPE), including without limitation, styrenic block copolymers, polyolefin blends, elastomeric alloys, thermoplastic polyurethanes, thermoplastic copolyester and thermoplastic polyamides. Examples of TPE products from the block copolymers group are STYROFLEX (BASF), KRATON (Shell Chemicals), PELLETHANE (Dow chemical), PEBAX, ARNITEL (DSM), HYTREL (Du Pont) and more. Examples of commercially available elastomeric alloys include SANTOPRENE (in-situ cross linked polypropylene and EPDM rubber; Monsanto), GEOLAST (Monsanto) and ALCRYN (Du Pont). Further examples of the materials that can be used to construct the annular member include, without limitation, thermoplastic vulcanizates (TPV; SANTOPRENE TPV), thermoplastic polyurethane (TPU), thermoplastic olefins (TPO), polysulfide rubber, ethylene propylene rubber (e.g., EPM, a copolymer of ethylene and propylene), ethylene propylene diene rubber (e.g., EPDM, a terpolymer of ethylene, propylene and a diene-component), epichlorohydrin rubber (ECO), polyacrylic rubber (ACM, ABR), silicone rubber (SI, Q, VMQ), fluorosilicone Rubber (FVMQ), fluoroelastomers (e.g., FKM, and FEPM, VITON, TECNOFLON, FLUOREL, AFLAS and DAI-EL), perfluoroelastomers (e.g., FFKM, TECNOFLON PFR, KALREZ, CHEMRAZ, PERLAST), polyether block amides (PEBA), chlorosulfonated polyethylene (CSM, e.g., HYPALON), ethylene-vinyl acetate (EVA), synthetic polyisoprene (IR), butyl rubber (copolymer of isobutylene and isoprene, IIR), halogenated butyl rubbers (chloro butyl rubber: CIIR; bromo butyl rubber: BIIR), polybutadiene (BR), styrene-butadiene rubber (copolymer of polystyrene and polybutadiene, SBR), nitrile rubber (copolymer of polybutadiene and acrylonitrile, NBR; Buna N rubbers), hydrogenated nitrile rubbers (HNBR, THERBAN and ZETPOL), chloroprene rubber (CR, polychloroprene, NEOPRENE, BAYPREN) and the like.

In some embodiments, the annular member is of a different color than the distal section and/or annual projections, and pipette tips may be provided with annular members having different colors (e.g., red, blue, yellow). Pipette tips of different sizes or for different uses can be provided in different colors, for example.

One or more portions of a pipette tip may comprise a filter, insert or other material. For example, one or more of a distal section, proximal section or annular member may include a filter, insert or other material. Filters of any shape useful for functioning as a barrier can be utilized (e.g., barrier to fluid or materials in a fluid), including without limitation, plugs and disks (e.g., U.S. Pat. Nos. 5,156,811 and 7,335,337). A filter can comprise any suitable filtration material, including without limitation, polyester, cork, plastic, silica, gels, and the like, and combinations thereof. In some embodiments a filter may be porous, non-porous, hydrophobic, hydrophilic or a combination thereof. A filter in some embodiments may include vertically oriented pores, and the pore size may be regular or irregular. In certain embodiments, a filter may include nominal, average or mean pore sizes of about 30, 25, 20, 15, 10, 9, 8, 7, 6, 5, 4, 3, 2, 1, 0.5, or 0.05 micrometers, for example. In certain embodiments the filter may have antimicrobial properties (e.g., the filter may include, may be impregnated with, or may be coated with an antimicrobial material (e.g., antimicrobial metal; silver; gold)). A filter can be located in any suitable location for filtration (e.g., located at or near a distal section aperture for pre-filtering; located at or near a proximal section for blocking fluid, aerosol or moisture from a drawn fluid).

A section of a pipette tip also may include an insert or material that can interact with a molecule of interest, such as a biomolecule. The insert or material may be located in any suitable location for interaction with a molecule of interest, and sometimes is located in the distal section of a pipette tip (e.g., a material or a terminus of an insert may be located at or near the terminal aperture of the distal section). An insert of material may comprise one or more components that include, without limitation, multicapillaries (e.g., US 2007/0017870), fibers (e.g., randomly oriented or stacked, parallel orientation), and beads (e.g., silica gel, glass (e.g. controlled-pore glass (CPG)), nylon, Sephadex®, Sepharose®, cellulose, a metal surface (e.g. steel, gold, silver, aluminum, silicon and copper), a magnetic material, a plastic material (e.g., polyethylene, polypropylene, polyamide, polyester, polyvinylidenedifluoride (PVDF)), Wang resin, Merrifield resin or Dynabeads®). Beads may be scintered (e.g., scintered glass beads) or may be free (e.g., between one or two barriers (e.g., filter, frit)). Each insert or material may be coated or derivitized (e.g., covalently or non-covalently modified) with a molecule that can interact with (e.g., bind to) a molecule of interest (e.g., C18, nickel, affinity substrate, antibody, ligand, cofactor, binding partner, metal and the like).

A pipette tip also may include one or more antimicrobial materials. An antimicrobial material may be coated on a surface (e.g., inner and/or outer surface) or impregnated in a pipette tip material, in some embodiments. One or more portions or sections, or all portions and sections, of a pipette tip may include one or more antimicrobial materials.

Figure 2:
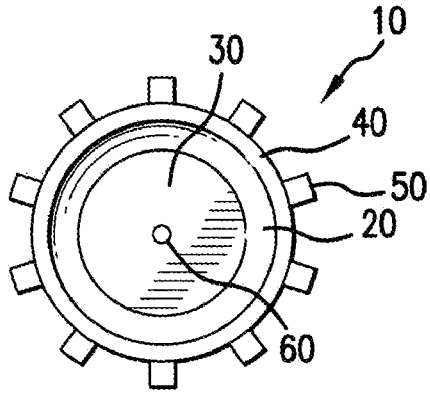
FIG. 2 shows a top view of pipette tip 10 shown in FIG. 1.

FIG. 1 is an isometric view of a pipette tip embodiment, and FIG. 2 is a top view. As shown in FIG. 1 and FIG. 2, a pipette tip 10 is provided with a proximal section 20 that can be attached to a pipette tip engagement end of a fluid dispensing device, and a distal section 30 that can contain a fluid. The distal section includes an aperture 60 through which fluid may be drawn into, or ejected from, pipette tip 10. The proximal section 20 further comprises annular member 40 and axial projections 50. One material often is used to construct the distal section 30 and the axial projections 50, and a relatively more flexible material often is used to construct the annular member 40. The annual member flexes in response to force (e.g., radial force introduced by insertion of a dispenser device into the pipette tip) while the axial projections do not measurably deform, or deform substantially less compared to the degree the annular member deforms. The distal section 30 often is connected to the proximal section 20. The pipette tip 10 often is disposable.

Dispensers

A dispenser mates with one or more pipette tips, and sometimes is referred to herein as a "pipet," "pipettor" and "dispensing device." A portion of a dispenser that engages a pipette tip sometimes is referred to herein as a "nozzle," "barrel" and "pipette tip engagement portion." Pipette tips can be used manually, where an operator manually operates a single channel pipette or a multichannel pipette (more than one dispensing outlet, e.g., available in 2, 4, 8, 12 or 16 channel configurations), in some embodiments. In certain embodiments, pipette tips can be used in conjunction with an automated or robotic dispenser, and robotic devices can be configured to engage 1, 2, 4, 8, 16, 24, 32, 40, 48, 56, 64, 72, 80, 88, 96, 384 or 1536 pipettes at a time, in some embodiments. Dispensers with 96 or more channels can be used in microtiter plate or array/chip applications for high throughput analysis of a large number of samples. In some embodiments, multiple channel dispensers can be used in laboratories for conducting nucleic acid amplification processes (e.g., polymerase chain reaction (PCR)), nucleic acid and polypeptide chip processes (e.g., DNA array, protein array and microfluidic device assays), immunological assays (ELISA, RIA), and the like. One non-limiting example of an automated or robotic device used for high throughput analysis is a device referred to as the Oasis LM (produced by Telechem International, Inc. Sunnyvale Calif. 94089). This computer-driven biological workstation can be configured with up to 4 separate pipette tip heads with the ability to pipette 1, 8, 96, 384 or 1536 samples. The range of volumes is dependent on the particular head and pipette tip combination, and the volume range for the workstation is from 200 nanoliters to 1 milliliter. The workstation can operate the four pipette heads simultaneously.

Methods for Manufacturing Pipette Tips

Pipette tips described herein sometimes are formed using a "double-shot" casting process, where the material that forms the annular member is introduced to a mold (also referred to as a "cast" herein) at a different time than the material that forms the distal section and axial projections of the pipette tip. The first material and second material often are introduced to the cast in liquid form. The cast sometimes is heated to a temperature above room temperature to allow each material to flow within the cast, and sometimes one or more agents that enhance material flow are introduced to the liquid material. In certain embodiments, the first material is introduced to the cast and then the second material is introduced to the cast after the first material has cured. The second material is introduced to the cast and then the first material is introduced to the cast after the second material has cured, in some embodiments.

A cast often is a body that can receive a material in liquid form that cures inside the body to form one or more portions of pipette tips. A cast can be manufactured from any material that does not significantly change shape during the process of manufacturing a pipette tip described herein. A cast often is constructed from a material that does not chemically interact with materials added to form the pipette tips, and casts sometimes are constructed from one or more metals (e.g., metal alloy or composite; aluminum; steel (e.g., stainless steel)). The term "cures" as used herein refers to a process in which a liquid material introduced into a cast hardens. One material may be fully cured or partially cured before another material is introduced to the cast. The term "curing agent" as used herein refers to an additive that modifies the curing rate of a material, and/or modifies a property (e.g., hardness) of a cured material, relative to the curing rate and properties of the material to which the curing agent has not been added.

In embodiments where axial projections present a surface in the pipette tip interior, an annular member (e.g., segmented annular member) may be formed by introducing the material that forms the relatively flexible regions at multiple injection sites in the cast. In embodiments where axial projections do not present a surface in the pipette tip interior, the annular member may be formed by introducing the material that forms the annular member at one location in the cast. A method of manufacture often comprises removing the formed pipette tip from the cast.

Pipette tips described herein may be manufactured by fabricating certain parts separately and fitting the parts together, in some embodiments. For example, an annular member may be manufactured separately from a piece containing the distal section and axial projections, and the annular member can be fitted to the piece (e.g., press fit; adhesive fit, weld fit) to form a pipette tip described herein.

Methods for Using Pipette Tips

In practice, one or more pipette tips can be arrayed to facilitate use by one or more pipette tip engagement portions of a dispenser. In an embodiment, a rack of pipette tips can be presented that comprises a plurality of the pipette tips described herein, for example. In this example, a plurality of nozzles is positioned above the rack such that the nozzles line up with the tips. The nozzles then are brought into contact with the attachment section of the pipette tip. As the nozzle is inserted into the attachment section, the flexible regions of the attachment section can expand to accept the nozzle while the rigid members provide structure and vertical support to the attachment section. The nozzle with the tip attached thereto withdraws, taking the tip with it. After the tip is used, force is applied to the tip, ejecting it from the nozzle (e.g., via a push plate). The force often is directed to the axial projections, which facilitates ejection. The one or more nozzles may be presented by a manual use dispensing device (e.g., manual single pipettor, manual multi-pipettor) in certain embodiments, and in some embodiments, the one or more nozzles are presented by an automated dispensing device (e.g., robotic dispenser).

Pipette tips described herein also may be used to process one or more molecules of interest (e.g., purify, isolate, concentrate, fractionate). A molecule of interest may be a biomolecule, including, without limitation, peptides, polypeptides, proteins, nucleic acids and cells. Pipette tips that include an insert or other solid support material that can interact with a molecule of interest sometimes are utilized for such purposes.

The terms "isolate", "isolating" or "isolation" as used herein refer to material removed from its original environment (e.g., the natural environment if it is naturally occurring, or a host cell if expressed exogenously), and thus is altered "by the hand of man" from its original environment.

The terms "isolate", "isolating" or "isolation" and "purify", "purifying" or "purification" as used herein with reference to molecules do not refer to absolute purity. Rather, "purify", "purifying" or "purification" refers to a substance in a composition that contains fewer substance species in the same class (e.g., nucleic acid or protein species) other than the substance of interest in comparison to the sample from which it originated. "Purified", "purifying" or "purification", if a nucleic acid or protein for example, refers to a substance in a composition that contains fewer nucleic acid species or protein species other than the nucleic acid or protein of interest in comparison to the sample from which it originated. "Concentrated", "concentrating", or "concentration" refers to the act of increasing the "molarity" of a substance species (e.g., nucleic acid or protein species), without also substantially increasing the molarity of any salts, buffering agents or other chemicals present in the sample solution. "Fractionated", "fractionating" or "fractionation" as used herein refers to the act of separating similar or dissimilar substance species using a chromatographic approach, for example, fractionation of nucleic acids extracted from a cell, where the object of fractionation is to remove protein or RNA, but maintain DNA, and sometimes the total population of DNA. The DNA can be fractionated from other substance species, but the result is different from purification because there are not fewer substance species in the same class.

As used herein, the term "polypeptide" refers to a molecular chain of amino acids and does not refer to or infer a specific length of the amino acid chain. Thus peptides, oligopeptides, and proteins are included within the term "polypeptide." This term also includes polypeptides that have been subjected to post-expression modifications such as glycosylations, acetylations, phosphorylations, and the like. As used herein, the term "protein" refers to any molecular chain of amino acids that is capable of interacting structurally, enzymatically or otherwise with other proteins, polypeptides, RNA, DNA, or any other organic or inorganic molecule.

As used herein, the term "nucleic acid" refers to polynucleotides such as deoxyribonucleic acid (DNA) and ribonucleic acid (RNA). The term should also be understood to include, as equivalents, derivatives, variants and analogs of RNA or DNA made from nucleotide analogs, single (sense or antisense) and double-stranded polynucleotides. It is understood that the term "nucleic acid" does not refer to or infer a specific length of the polynucleotide chain, thus nucleotides, polynucleotides, and oligonucleotides are also included within the term "nucleic acid." Deoxyribonucleotides include deoxyadenosine, deoxycytidine, deoxyguanosine and deoxythymidine. For RNA, the uracil base is uridine. Different forms and types of nucleic acids can be contacted by devices described herein, including without limitation, genomic, plasmid, circular, linear, hairpin, ribozyme, antisense, triplex, short heteronuclear RNA (shRNA), short inhibitory RNA (siRNA) and inhibitory RNA (RNAi). As used herein "material that binds to a nucleic acid" refers to any organic or inorganic molecules that can specifically or non-specifically bind to a nucleic acid. Included in the category "organic or inorganic molecule" are peptides, polypeptides, proteins, proteins subjected to post-translational modification, other nucleic acids, nucleic acids containing modified nucleotides, and antibodies. Material bound to nucleic acid sometimes is present in a sample from which the nucleic acid is being processed, such as cellular components that bind to nucleic acid.

As used herein, "biomolecule association conditions" or "biological agent association conditions" refers to conditions under which a biomolecule or biological agent associates with an insert or other material that interacts with a molecule of interest. The term "associates" as used herein refers to specific and/or non-specific interactions between the biomolecule or biological agent and a solid phase. The association often is reversible, in some embodiments is irreversible, and sometimes the association is a binding interaction. Biomolecule association conditions in some embodiments are specific temperatures and/or concentrations of certain components that facilitate association of a biomolecule or biological agent to a bead or insert solid support, including without limitation, salt, buffer agent, carrier molecule and chaotrope concentration. As used herein, the term "wash" refers to exposing a solid support to conditions that remove materials from the solid support that are not the biological agent(s) of interest. As used herein, the term "elute" refers to exposing a solid support to conditions that de-associate the biological agent(s) of interest from the solid support.

In certain embodiments, a nucleic acid (e.g., DNA) is associated with a glass solid support (e.g., silica) in an insert or bead, and several association conditions are known in the art (e.g., World Wide Web URL biology-web.nmsu.edu/nish/Documents/reprints %20&%20supplemental/DNA%20Isolation%20Procedures.pdf). For example, it is known that DNA binds to silica under conditions of high ionic strength and/or high chaotrope concentration. High DNA adsorption efficiencies are shown to occur in the presence of a buffer solution having a pH at or below the pKa of the surface silanol groups.

Biomolecule binding conditions sometimes are categorized as being of low stringency or high stringency. Devices described herein can be utilized at elevated temperatures for use with stringent hybridization protocols. An example of stringent hybridization conditions is hybridization in 6× sodium chloride/sodium citrate (SSC) at about 45° C., followed by one or more washes in 0.2× SSC, 0.1% SDS at 50° C. Another example of stringent hybridization conditions are hybridization in 6× sodium chloride/sodium citrate (SSC) at about 45° C., followed by one or more washes in 0.2× SSC, 0.1% SDS at 55° C. A further example of stringent hybridization conditions is hybridization in 6× sodium chloride/sodium citrate (SSC) at about 45° C., followed by one or more washes in 0.2× SSC, 0.1% SDS at 60° C. Another stringent hybridization conditions are hybridization in 6× sodium chloride/sodium citrate (SSC) at about 45° C., followed by one or more washes in 0.2×SSC, 0.1% SDS at 65° C. Certain stringency conditions are 0.5M sodium phosphate, 7% SDS at 65° C., followed by one or more washes at 0.2×SSC, 1% SDS at 65° C.

Nucleic acid binding can also occur by other specific or nonspecific means. Non-limiting examples of nucleic acid binding conditions include (i) high salt binding (e.g., high ionic conditions as in the case of non-specific interactions with glass) where DNA binding occurs in the range of about 0.75M sodium chloride to about 1.25M sodium chloride, followed by elution with concentrations of sodium chloride ranging from 1.25M to 1.6M; and (ii) low salt binding (e.g., low ionic conditions as in the case for C18 coated solid supports) where nonspecific hydrophobic binding occurs in aqueous buffers with concentrations in the range of about 0 to about 0.1 Molar (M) salts, and where the bound nucleic acids can be eluted with increasing gradients of organic mobile phase, like acetonitrile, up to 30%, up to 40%, 50%, 60%, 70%, 80%, and even 90%, for example. The exact binding and elution conditions often are dependent on the size and sequence of the nucleic acid. Non-limiting examples of nucleic acid binding conditions are available in the protocols of the following commercially available catalogs: PureLink quick plasmid miniprep kit (Invitrogen, Cat. No. K2100-10 or K2100-11), Wizard plus SV Minipreps DNA purification System (Promega, Cat. No. A1330 or A1460), QIAprep Spin Miniprep Kit (Qiagen, Cat. No. 27104 or 27106) and GenElute plasmid kids (Cat. No. PLN-50, PLN-70, PLN-250 and PLN-350).

A bind-wash-elute procedure can be utilized to process a nucleic acid from a sample using a device described herein. In certain embodiments, nucleic acids are adsorbed to a solid support, optionally in the presence of one or more chaotropic agents, which remove water from hydrated molecules in solution. Examples of chaotropic agents include without limitation guanidinium salts (e.g., guanidinium hydrochloride and guanidium thiocyanate) and urea, and can be utilized at concentrations of 0.5M to 7M in certain embodiments. Polysaccharides and proteins do not adsorb to the solid support and are removed. After a wash step, nucleic acids are eluted under low- or no-salt conditions in small volumes, ready for immediate use without further concentration. Nucleic acid first may be isolated from a sample source (e.g., cells) by methods known to the person of ordinary skill in the art. For example, an alkaline lysis procedure may be utilized. The latter procedure traditionally incorporates the use of phenol-chloroform solutions, and an alternative phenol-chloroform-free procedure involving three solutions can be utilized. In the latter procedures, solution 1 (binding) can contain 15 mM Tris, pH 8.0; 10 mM EDTA and 100 ug/ml Rnase A; solution 2 (washing) can contain 0.2N NaOH and 1% SDS; and solution 3 (eluting) can contain 3M KOAc, pH 5.5.

A bind-wash-elute procedure also can be utilized with insert and bead solid phases comprising silica derivatized with a positively charged moiety. In certain embodiments, a silica material having a high density of diethylaminoethyl (DEAE) groups can be used to isolate nucleic acids. Isolation is based on the interaction between negatively charged phosphates of the nucleic acid backbone and positively charged DEAE groups on the surface of the resin. Other charged groups can be utilized, including without limitation diethyl-(2-hydroxypropyl)aminoethyl, trimethylamine and the like. The salt concentration and pH conditions of the buffers used in each step control binding, wash stringency, and elution of nucleic acids. Combinations of pH conditions and buffers are described at World Wide Web address URL qiagen.com/Plasmid/AnionExchangeResin.aspx. For example, a salt concentration (e.g., NaCl) in the range of about 0.4M to about 2.0M may be used with a pH in the range of about 6.0 to about 9.0 for extraction of DNA or RNA, where a higher salt concentration is utilized with a lower pH solution.

A solid phases support can be functionalized with one or more affinity-binding reagents, such as specific nucleic acids (e.g., gene sequences), specific peptides, antibodies and other organic or inorganic molecules. Conditions for associating biomolecules with such functionalized solid phases are known in the art. Conditions for washing and eluting biomolecules from such supports also are known in the art. For example, polypeptides can be eluted by increasing amounts of organic solvents, such as acetonitrile (e.g., about 30%, 40%, 50%, 60%, 70%, 80%, 90%). One of ordinary skill in the art will appreciate that the exact binding and elution conditions are dependent on, and can be tailored to, the size and sequence of the biomolecule of interest and the solid phase to which it is associated.

Biomolecules processed using devices described herein can be detected by a suitable method known in the art. Methods for detecting polypeptides are known (e.g., Coomassie blue, Bradford reagent) and methods for detecting nucleic acids also are known. For example, measuring the intensity of absorbance of a DNA solution at wavelengths 260 nm and 280 nm is used as a measure of DNA purity. DNA absorbs ultraviolet (UV) light at 260 and 280 nm, and aromatic proteins absorbs UV light at 280 nm; a pure sample of DNA has the 260/280 ratio at 1.8 and is relatively free from protein contamination. A DNA preparation contaminated with protein will have a 260/280 ratio lower than 1.8. In another example, a DNA sample processed using a device described herein can be amplified using a technique known in the art, such as polymerase chain reaction (PCR) and transcription mediated amplification (TMA) processes, for example. Quantitative PCR (Q-PCR) processes are known in the art for determining the amount of a particular DNA sequence in a sample. Also, DNA can be quantified by cutting with a restriction enzyme, electrophoresing products in an agarose gel, staining with ethidium bromide or a different stain and comparing the intensity of the DNA with a DNA marker of known concentration. Nucleic acid also can be quantified by diphenylamine (DPA) indicators by spectrometric detection at 600 nm and use of a standard curve of known nucleic acid concentrations.

EXAMPLES

Examples of embodiments set forth below illustrate, and do not limit, the technology.

A1. A disposable pipette tip, which comprises (i) a distal section, and (ii) a proximal section comprising a plurality of axial projections that extend from the distal section and are circumferentially disposed around the exterior surface of an annular member, wherein:

the annular member is disposed coaxially with respect to the distal section, the projections and the distal section consist essentially of a first material and the annular member consists essentially of a second material relatively more compliant than the first material, and the projections cover a portion of the surface area of the annual member, whereby portions of the annular member between the projections are exposed.

A2. The disposable pipette tip of embodiment A1, wherein the projections are coaxially disposed relative to the longitudinal axis of the distal section.

A3. The disposable pipette tip of embodiment A1 or A2, wherein the proximal section comprises a ring in connection with the ends of the projections.

A4. The disposable pipette tip of embodiment A3, wherein the ring consists of the first material.

A5. The disposable pipette tip of any one of embodiments A1-A4, wherein the second material is a moldable thermoplastic elastomer.

A6. The disposable pipette tip of any one of embodiments A1-A5, wherein the first material is polyethylene.

A7. The disposable pipette tip of any one of embodiments A1-A6, wherein a portion of the annular member is in effective contact with the distal section.

A7.1. The disposable pipette tip of any one of embodiments A1-A7, wherein the portions of the annular member between the projections deform when a pipette device is inserted into the proximal portion of the pipette tip A8. A method for manufacturing the disposable pipette tip of any one of embodiments A1-A7, which comprises:

providing a cast;

introducing the first material to the cast; and introducing the second material to the cast.

A9. The method of embodiment A8, wherein the first material is introduced to the cast and then the second material is introduced to the cast after the first material has cured.

A10. The method of embodiment A8, wherein the second material is introduced to the cast and then the first material is introduced to the cast after the second material has cured.

A11. The method of any one of embodiments A8-A10, which comprises removing the disposable pipette tip from the cast.

A12. A method for using the disposable pipette tip of any one of embodiments A1-A7, which comprises:

inserting a pipette device into the proximal section of the disposable pipette tip, wherein the portions of the annular member between the projections deform; and applying negative pressure to the disposable pipette tip via the pipette device and introducing a liquid into the distal portion of the disposable pipette tip.

A13. The method of embodiment A12, which comprises ejecting the liquid from the distal portion of the disposable pipette tip.

A14. The method of embodiment A12 or A13, which comprises ejecting the disposable pipette tip from the pipette device.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the technology. Although the technology has been described in substantial detail with reference to one or more specific embodiments, those of ordinary skill in the art will recognize that changes may be made to the embodiments specifically disclosed in this application, yet these modifications and improvements are within the scope and spirit of the technology described herein.

The technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the claimed technology. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" is about 1, about 2 and about 3). For example, a weight of "about 100 grams" can include weights between 90 grams and 110 grams. Further, when a listing of values is described herein (e.g., 50%, 60%, 70% or 80%), the listing includes all intermediate values thereof (e.g., 62%, 77%). Thus, it should be understood that although the technology described herein has been specifically disclosed by representative embodiments and optional features, modification and variation of the concepts herein disclosed may be resorted to by those skilled in the art, and such modifications and variations are considered within the scope of this technology.

Embodiments of the technology are set forth in the claims that follow.

What is claimed is:

1. A disposable pipette tip, which comprises (i) a distal section, and (ii) a proximal section comprising a plurality of axial projections that extend from the distal section and are circumferentially disposed around the exterior surface of an annular member, wherein:

the annular member is disposed coaxially with respect to the distal section, the projections and the distal section consist essentially of a first material and the annular member consists essentially of a second material relatively more compliant than the first material, and the projections cover a portion of the surface area of the annular member, whereby portions of the annular member between the projections are exposed.

2. The disposable pipette tip of claim 1, wherein the projections are coaxially disposed relative to the longitudinal axis of the distal section.

3. The disposable pipette tip of claim 2, wherein the second material is a thermoplastic elastomer.

4. The disposable pipette tip of claim 2, wherein the first material is polyethylene.

5. The disposable pipette tip of claim 2, wherein a portion of the annular member is in contact with the distal section.

6. A method for manufacturing the disposable pipette tip of claim 2, which comprises:

providing a cast;

introducing the first material to the cast; and introducing the second material to the cast, wherein the first material and second material are introduced to the cast in liquid form.

7. The method of claim 6, wherein the first material is introduced to the cast and then the second material is introduced to the cast after the first material has cured.

8. The method of claim 6, wherein the second material is introduced to the cast and then the first material is introduced to the cast after the second material has cured.

9. The method of claim 6, which comprises removing the disposable pipette tip from the cast.

10. A method for using the disposable pipette tip of claim 2, which comprises:

inserting a pipette device into the proximal section of the disposable pipette tip, wherein the portions of the annular member between the projections deform; and applying negative pressure to the disposable pipette tip via the pipette device and introducing a liquid into the distal portion of the disposable pipette tip.

11. The method of claim 10, which comprises ejecting the liquid from the distal portion of the disposable pipette tip.

12. The method of claim 10, which comprises ejecting the disposable pipette tip from the pipette device.

13. The disposable pipette tip of claim 1, wherein the portions of the annular member between the projections deform when a pipette device is inserted into the proximal portion of the pipette tip.

* * * * *